US010697684B2

(12) United States Patent
Bertolini et al.

(10) Patent No.: US 10,697,684 B2
(45) Date of Patent: Jun. 30, 2020

(54) AUTOMATIC ICE-SPHERE-MAKING SYSTEM FOR REFRIGERATOR APPLIANCE

(71) Applicants: BSH Home Appliances Corporation, Irvine, CA (US); BSH Hausgeräte GmbH, Munich (DE)

(72) Inventors: Nilton Bertolini, Knoxville, TN (US); James Hoban, Knoxville, TN (US); Silas Patrick Mallon, Knoxville, TN (US); Jorge Carlos Montalvo Sanchez, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 39 days.

(21) Appl. No.: 15/925,799

(22) Filed: Mar. 20, 2018

(65) Prior Publication Data

US 2019/0293335 A1 Sep. 26, 2019

(51) Int. Cl.

| | |
|---|---|
| ***F25C 1/25*** | (2018.01) |
| ***F25C 1/06*** | (2006.01) |
| ***F25C 1/24*** | (2018.01) |

(52) U.S. Cl.

CPC ..... *F25C 1/24* (2013.01); *F25C 1/06* (2013.01); *F25C 1/25* (2018.01); *F25D 2331/80* (2013.01)

(58) Field of Classification Search

CPC ..... F25C 1/06; F25C 1/24; F25C 1/25; F25C 1/04; F25C 5/08; F25C 2305/022; F25C 1/18; F25C 1/22; F25D 2331/80

See application file for complete search history.

(56) References Cited

U.S. PATENT DOCUMENTS

| | | | | |
|---|---|---|---|---|
| 2,083,081 | A * | 6/1937 | Moll | A23G 9/083 249/120 |
| 4,852,359 | A * | 8/1989 | Manzotti | F25C 1/10 62/68 |
| 4,910,974 | A * | 3/1990 | Hara | F25C 1/045 62/347 |
| 6,857,277 | B2 | 2/2005 | Somura | |
| 9,234,688 | B2 * | 1/2016 | Son | F25C 1/04 |
| 9,273,891 | B2 * | 3/2016 | Boarman | F25B 21/02 |
| 9,310,116 | B2 * | 4/2016 | Culley | F25C 1/25 |
| 9,335,081 | B2 | 5/2016 | Son et al. | |
| 9,581,372 | B2 * | 2/2017 | Lee | F25C 1/04 |
| 9,599,385 | B2 * | 3/2017 | Guarino | F25C 1/24 |
| 9,677,800 | B2 | 6/2017 | Kim et al. | |

(Continued)

*Primary Examiner* — Frantz F Jules
*Assistant Examiner* — Martha Tadesse
(74) *Attorney, Agent, or Firm* — Michael E. Tschupp; Andre Pallapies; Brandon G. Braun

(57) ABSTRACT

An automatic spherical ice maker includes an upper stationary ice mold having at least one ice cavity with a hemispherical shape, and a lower rotatable ice mold having at least one ice cavity with a hemispherical shape and corresponding to the ice cavity of the upper stationary ice mold, so that together the at least one ice cavity of the upper stationary ice mold and the at least one cavity of the lower rotatable ice mold form at least one spherical mold which is configured to produce at least one substantially spherical ice ball at a time. The upper stationary ice mold has a first heating element and the lower rotatable ice mold has a second heating element, thereby to facilitate release of the at least one spherical ice ball from the at least one spherical mold.

23 Claims, 7 Drawing Sheets

(56) References Cited

U.S. PATENT DOCUMENTS

| | | | | |
|---|---|---|---|---|
| 2007/0107447 | A1* | 5/2007 | Langlotz | F25C 1/243 62/66 |
| 2013/0014536 | A1* | 1/2013 | Son | F25C 1/04 62/351 |
| 2014/0165618 | A1* | 6/2014 | Culley | F25C 1/25 62/71 |
| 2014/0182325 | A1* | 7/2014 | Lee | F25C 1/04 62/351 |
| 2015/0276295 | A1* | 10/2015 | Barrena | F25C 1/04 62/135 |
| 2016/0084558 | A1* | 3/2016 | Boarman | F25C 1/22 62/3.63 |
| 2016/0138844 | A1* | 5/2016 | Boarman | F25C 1/10 62/66 |
| 2017/0016663 | A1* | 1/2017 | Culley | F25C 1/18 |

* cited by examiner

AUTOMATIC ICE-SPHERE-MAKING SYSTEM FOR REFRIGERATOR APPLIANCE

FIELD OF THE INVENTION

The present disclosure relates generally to a refrigerator appliance and to an automatic ice-sphere-making system for the refrigerator appliance. More particularly, the present disclosure relates to an automatic spherical ice maker that can be fixed in the refrigerator appliance or used in place of a conventional ice cube maker.

Moreover, the automatic spherical ice maker can be positioned for example in a freezer compartment of the refrigerator appliance or in a dedicated ice making compartment located within a fresh food compartment of the refrigerator appliance.

BACKGROUND OF THE INVENTION

In general, clear spherical ice pieces have become popular and are used in bourbon, scotch, whiskey, craft cocktails, soft drinks, and other drinks. The clear spherical ice piece is desirable for use in such drinks because of its slow melting rate, large surface area, and attractive visual appearance.

The standard practice currently used to produce spherical ice pieces is to use a manual process which relies on an insulated mold that is manually filled with water, placed in the freezer compartment by the user/consumer, and then when the water is frozen the spherical ice pieces are manually harvested by the user/consumer. However, the insulated mold requires a significant amount of time to freeze the water, thus allowing dissolved solids to precipitate and allow for degasification of the water. While the manual process is adequate to produce spherical ice pieces, it is extremely slow and requires manual input from the user/consumer.

An ice-ball press is also known which is manually filled with ice and then the press forms a single sphere of ice with the help of gravity. Again, the ice-ball press is both time consuming and inefficient.

SUMMARY OF THE INVENTION

However, there is currently no home refrigerator appliance on the market with an installed automatic ice maker that is capable of producing clear spherical ice pieces.

An apparatus consistent with the present disclosure is directed to providing an automatic spherical ice maker that can be fixed in a refrigerator appliance or interchanged with and replace an existing ice cube maker in the refrigerator appliance.

An apparatus consistent with the present disclosure is directed to providing an automatic spherical ice maker that can be positioned for example in a freezer compartment of the refrigerator appliance or in a dedicated ice making compartment located within a fresh food compartment of the refrigerator appliance.

According to one aspect, the present disclosure provides a refrigerator comprising: an ice compartment region disposed in at least one of a fresh food compartment or a freezer compartment; and an automatic spherical ice maker disposed in the ice compartment region, the automatic spherical ice maker including an upper stationary ice mold having at least one ice cavity with a hemispherical shape, and a lower rotatable ice mold having at least one ice cavity with a hemispherical shape and corresponding to the ice cavity of the upper stationary ice mold, so that together the at least one ice cavity of the upper stationary ice mold and the at least one cavity of the lower rotatable ice mold form at least one spherical mold which is configured to produce at least one substantially spherical ice ball at a time, wherein the upper stationary ice mold has a first heating element and the lower rotatable ice mold has a second heating element, thereby to facilitate release of the at least one spherical ice ball from the at least one spherical mold.

According to another aspect, the upper stationary ice mold has two ice cavities each with a hemispherical shape, and the lower rotatable ice mold has two ice cavities each with a hemispherical shape and respectively corresponding to the two ice cavities of the upper stationary mold, so that together the two ice cavities of the upper stationary ice mold and the two ice cavities of the lower rotatable ice mold form two spherical molds which are configured to produce two substantially spherical ice balls at a time.

According to another aspect, the at least one spherical ice ball has a diameter of approximately 2.5 inches.

According to another aspect, the lower rotatable ice mold is fixedly mounted to a driven shaft via two spaced-apart extension arms.

According to another aspect, the driven shaft includes a driven gear which is coupled to a drive shaft via a drive gear, and the drive shaft is coupled to a drive motor.

According to another aspect, the drive motor comprises one of a DC motor or a stepper motor.

According to another aspect, the lower rotatable ice mold has an upper flange portion that surrounds the two ice cavities, and wherein the upper flange portion is formed with a groove for receiving a seal member for providing a seal between the upper stationary ice mold and the lower rotatable ice mold on condition that the lower rotatable ice mold is in a closed position to form the two spherical molds.

According to another aspect, the two ice cavities of the upper stationary ice mold are mounted on and extend below a mold support plate.

According to another aspect, an upper surface of the mold support plate has a generally U-shaped recess or groove for receiving the first heating element.

According to another aspect, the mold support plate has a pair of air-vent-filler tubes disposed in respective openings formed in an upper surface of the mold support plate.

According to another aspect, each one of the pair of air-vent-filler tubes includes a plurality of outer cutouts formed in a flange portion that is disposed in a corresponding one of the openings formed in the upper surface of the mold support plate.

According to another aspect, the automatic spherical ice maker is configured to be either fixed in the ice compartment region of the refrigerator, or interchanged with and replace an existing ice cube maker in the ice compartment region of the refrigerator appliance.

According to another aspect, the present disclosure provides an automatic spherical ice maker automatic spherical ice maker for a refrigerator appliance, comprising: an upper stationary ice mold having at least one ice cavity with a hemispherical shape, and a lower rotatable ice mold having at least one ice cavity with a hemispherical shape and corresponding to the ice cavity of the upper stationary ice mold, so that together the at least one ice cavity of the upper stationary ice mold and the at least one cavity of the lower rotatable ice mold form at least one spherical mold which is configured to produce at least one substantially spherical ice ball at a time, wherein the upper stationary ice mold has a first heating element and the lower rotatable ice mold has a second heating element, thereby to facilitate release of the at least one spherical ice ball from the at least one spherical mold.

According to another aspect, the upper stationary ice mold has two ice cavities each with a hemispherical shape, and the lower rotatable ice mold has two ice cavities each with a hemispherical shape and respectively corresponding to the two ice cavities of the upper stationary mold, so that together the two ice cavities of the upper stationary ice mold and the two ice cavities of the lower rotatable ice mold form two spherical molds which are configured to produce two substantially spherical ice balls at a time.

According to another aspect, the at least one spherical ice ball has a diameter of approximately 2.5 inches.

According to another aspect, the lower rotatable ice mold is fixedly mounted to a driven shaft via two spaced-apart extension arms.

According to another aspect, the driven shaft includes a driven gear which is coupled to a drive shaft via a drive gear, and the drive shaft is coupled to a drive motor.

According to another aspect, the drive motor comprises one of a DC motor or a stepper motor.

According to another aspect, the lower rotatable ice mold has an upper flange portion that surrounds the two ice cavities, and wherein the upper flange portion is formed with a groove for receiving a seal member for providing a seal between the upper stationary ice mold and the lower rotatable ice mold on condition that the lower rotatable ice mold is in a closed position to form the two spherical molds.

According to another aspect, the two ice cavities of the upper stationary ice mold are mounted on and extend below a mold support plate.

According to another aspect, an upper surface of the mold support plate has a generally U-shaped recess or groove for receiving the first heating element.

According to another aspect, the mold support plate has a pair of air-vent-filler tubes disposed in respective openings formed in an upper surface of the mold support plate.

According to another aspect, each one of the pair of air-vent-filler tubes includes a plurality of outer cutouts formed in a flange portion that is disposed in a corresponding one of the openings formed in the upper surface of the mold support plate.

According to another aspect, the present disclosure provides an automatic spherical ice maker for a refrigerator appliance, comprising: an upper stationary ice mold having at least one ice cavity with a hemispherical shape, and a lower rotatable ice mold having at least one ice cavity with a hemispherical shape and corresponding to the ice cavity of the upper stationary ice mold, so that together the at least one ice cavity of the upper stationary ice mold and the at least one cavity of the lower rotatable ice mold form at least one spherical mold which is configured to produce at least one substantially spherical ice ball at a time, wherein the automatic spherical ice maker is configured to be interchanged with and replace an existing ice cube maker in the refrigerator appliance.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 5A:
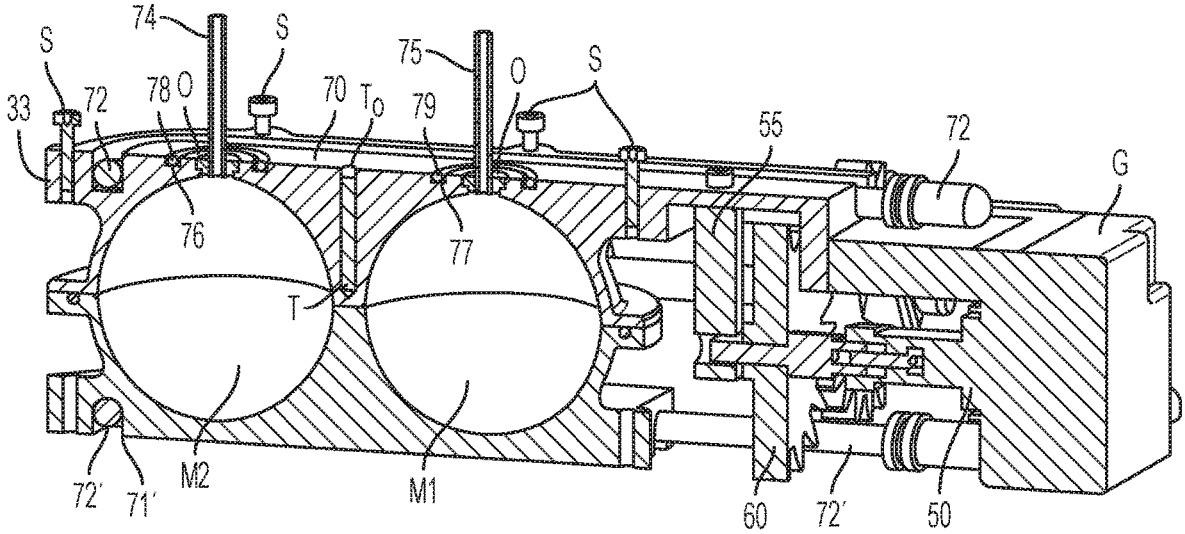
Figure 5B:
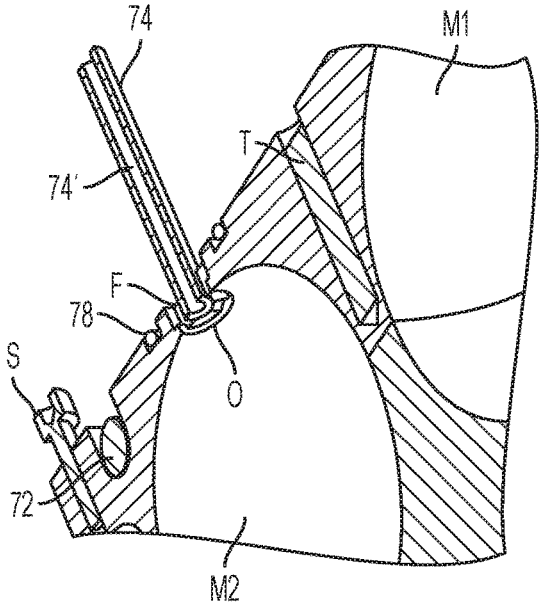
Figure 5C:
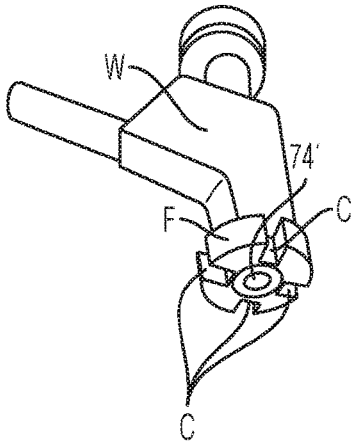
Figure 6:
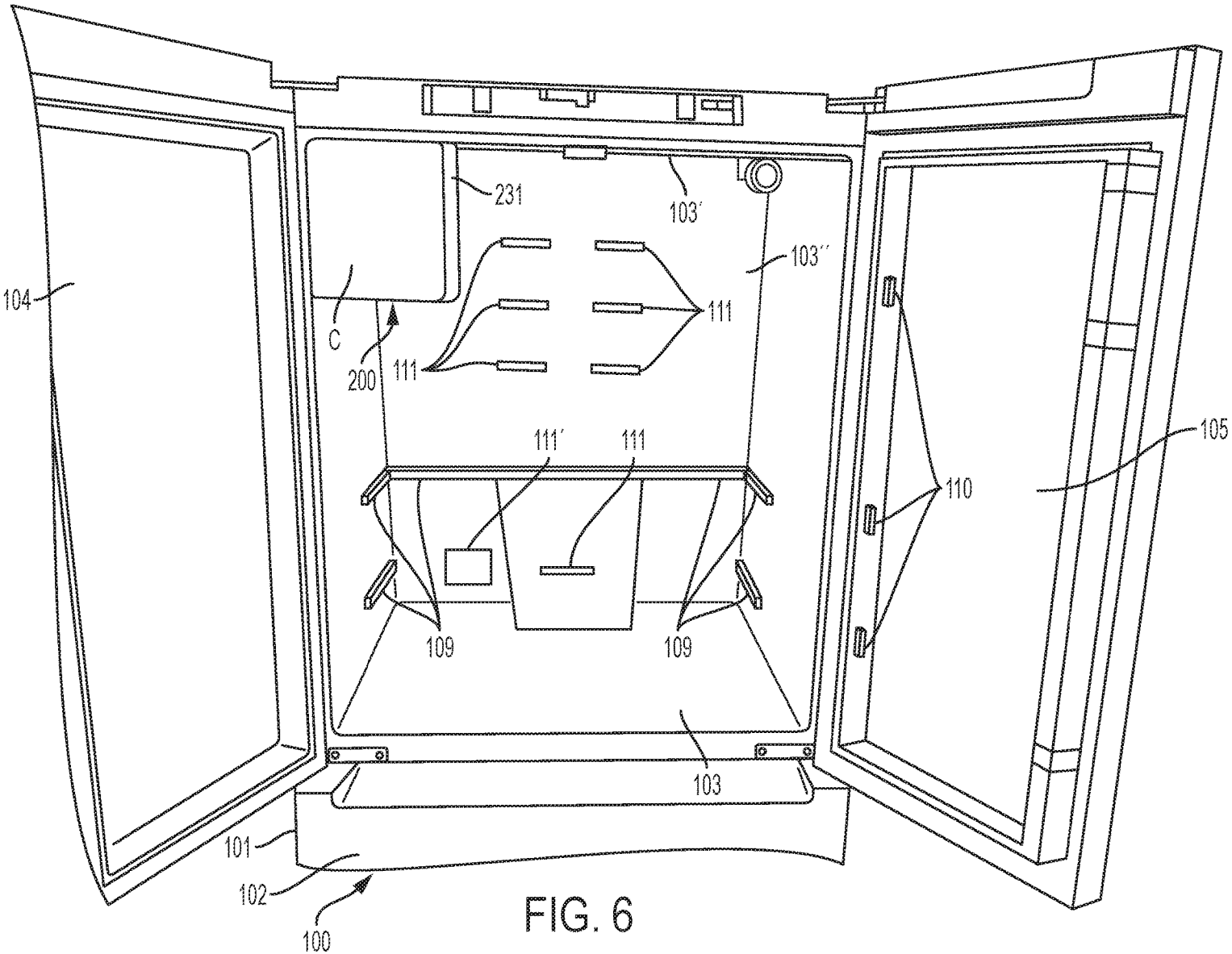
Figure 7:
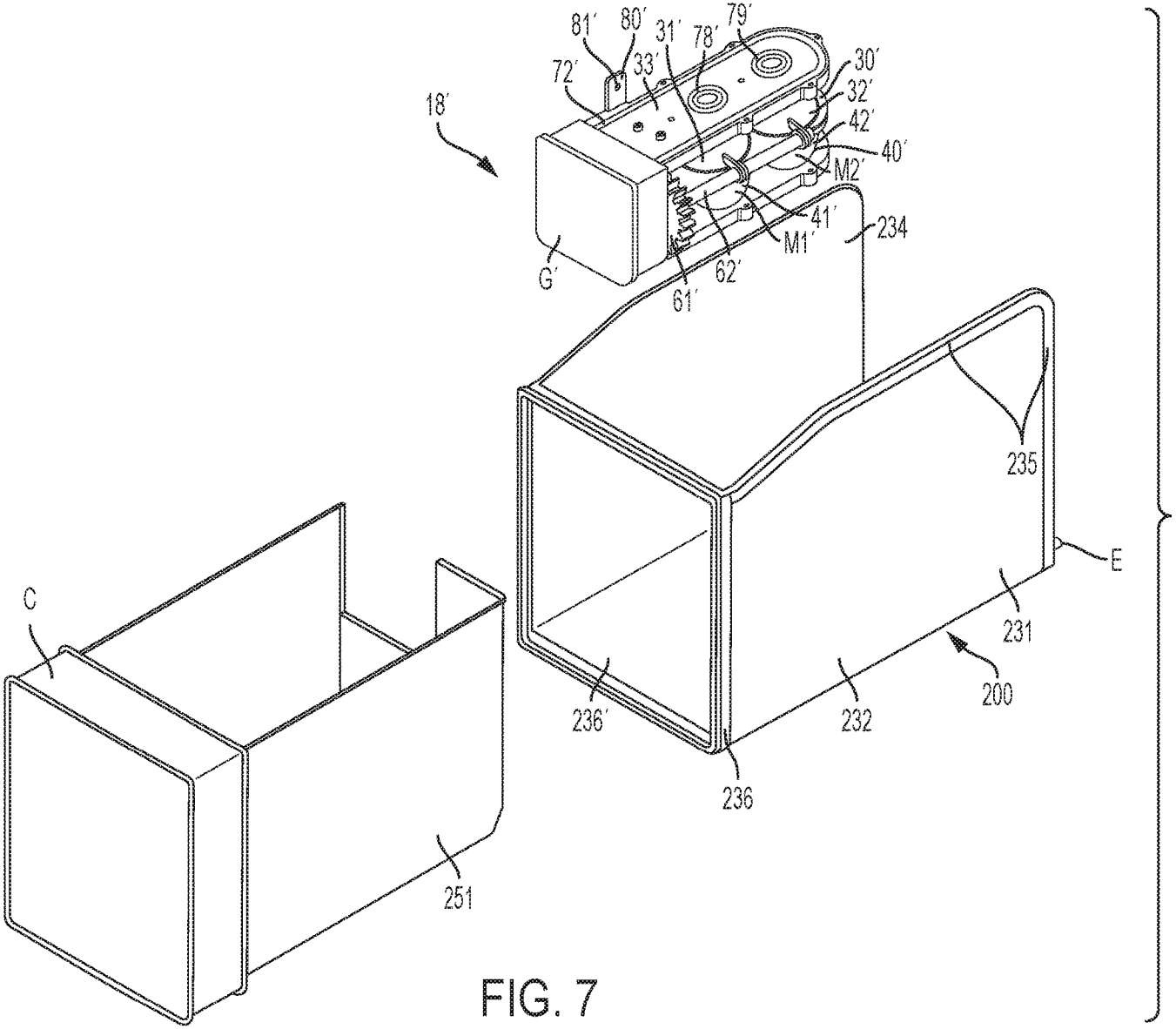
Figure 8:
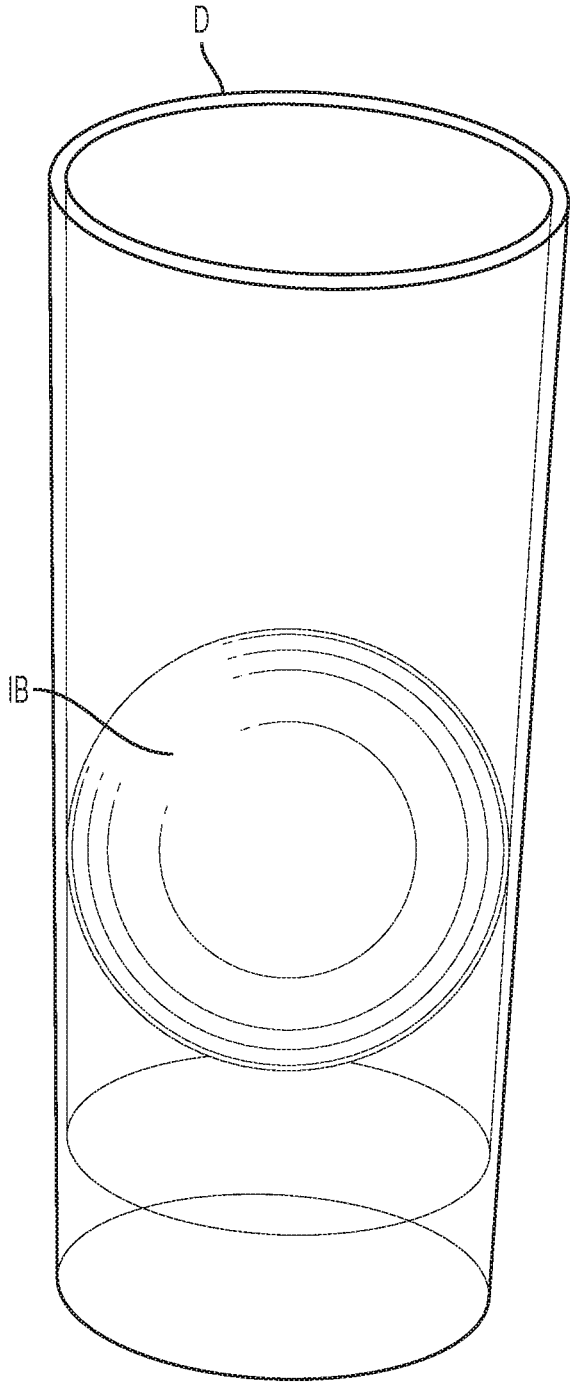

FIGS. 5A, 5B, and 5C are enlarged fragmentary views showing details of the automatic spherical ice maker per se according to an exemplary embodiment consistent with the present disclosure;

FIG. 6 is a fragmentary perspective view showing the inside of a refrigerator appliance including an automatic spherical ice maker and an ice bucket in for use with an ice compartment region located in a fresh food compartment according to an exemplary embodiment consistent with the present disclosure;

FIG. 7 is an exploded perspective view showing the ice compartment region of FIG. 6 according to an exemplary embodiment consistent with the present disclosure; and FIG. 8 illustrates a view of one substantially spherical ice ball produced by the automatic spherical ice maker according to an exemplary embodiment consistent with the present disclosure and disposed in a drinking glass.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, upper, lower, and the like used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
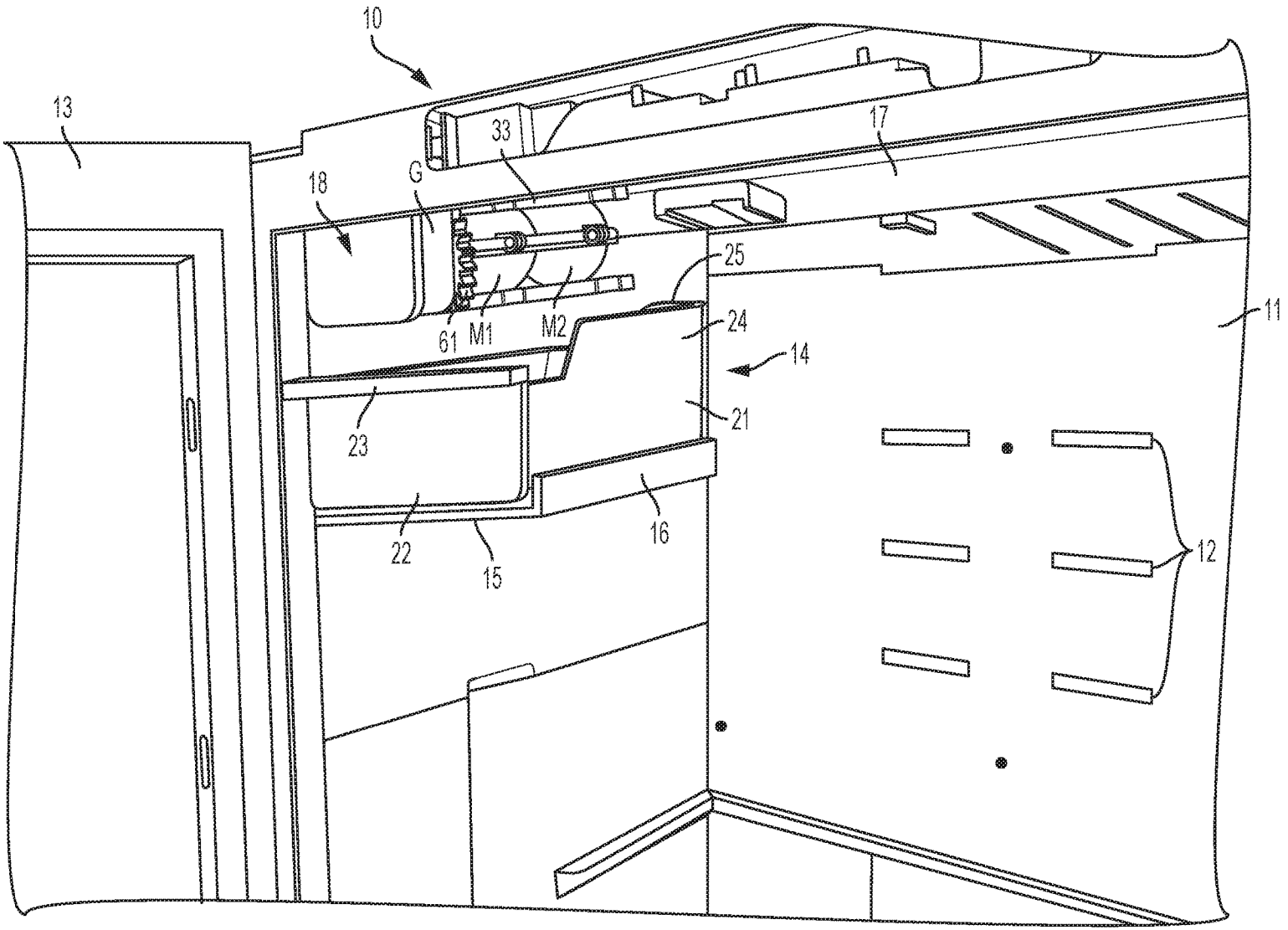
FIG. 1 is a fragmentary perspective view showing the inside of a refrigerator appliance including an automatic spherical ice maker and an ice bucket in an ice compartment region located in a freezer compartment according to an exemplary embodiment consistent with the present disclosure.

FIG. 1 is a fragmentary perspective view showing the inside of a refrigerator appliance including an automatic spherical ice maker and an ice bucket in an ice compartment region located in a freezer compartment according to an exemplary embodiment consistent with the present disclosure. FIG. 1 shows a refrigerator appliance 10 and, in particular, the inside of a freezer compartment 11 having inlets 12 for introducing cold air, with the return air opening not being visible in the figure. At least one door 13 is mounted such as by hinges for providing access to and for closing the freezer compartment 11. In the upper left corner, for example, an ice compartment region 14 is provided and is at least partially defined by an L-shaped floor portion 15.

Although the L-shaped floor portion 15 is shown with a short vertical side wall 16, the vertical side wall 16 can extend, for example, halfway or all the way to the ceiling 17 of the freezer compartment 11. An automatic spherical ice maker 18 is disposed in the uppermost left corner of the freezer compartment 11 in the ice compartment region 14. The automatic spherical ice maker 18 is configured to make clear ice in the form of ice pieces that have a substantially spherical shape or spherical ice ball. The particulars of the automatic spherical ice maker 18 will be discussed in detail below with reference to FIGS. 2-5C.

An ice bucket 21 is provided underneath the automatic spherical ice maker 18. Although the term ice bucket is used, ice bin, ice storage container, and the like are alternative terms for describing the ice bucket 21. The ice bucket 21 is shown as a removable ice bucket for storing ice, the removable ice bucket being removably disposed in the ice compartment region 14. The ice bucket 21 has a front portion 22 with a grip 23 for a user to grasp with their fingers to pull and slide the ice bucket 21 out of the ice compartment region 14 to access the spherical ice balls or empty the spherical ice balls from the ice bucket 21. The ice bucket 21 rests on the L-shaped floor portion 15 when it is inserted into the ice compartment region 14. The ice bucket 21 may have a raised side wall portion 24 and raised rear wall portion 25 to help retain the ice pieces as they fall into the ice bucket 21 from the automatic spherical ice maker 18 during harvest and during storage as the level of the ice pieces increases in the ice bucket 21. A level detection device such as a bail arm (not shown) is configured to turn the automatic spherical ice maker 18 on when the level of the spherical ice balls has gone below a preset level as the user removes the spherical ice balls from the ice bucket 21 for use, as well as turn off the automatic spherical ice maker 18 when the spherical ice balls have reached a preset full level in the ice bucket 21. For example, this could be just a single layer of spherical ice balls in the ice bucket 21 in the case that the spherical ice balls are large, such as 2.5 inches in diameter. Also, other level sensing devices could be used such as optical sensors.

With reference to FIGS. 2-5C, the particulars of the automatic spherical ice maker 18 will now be discussed.

Figure 2:
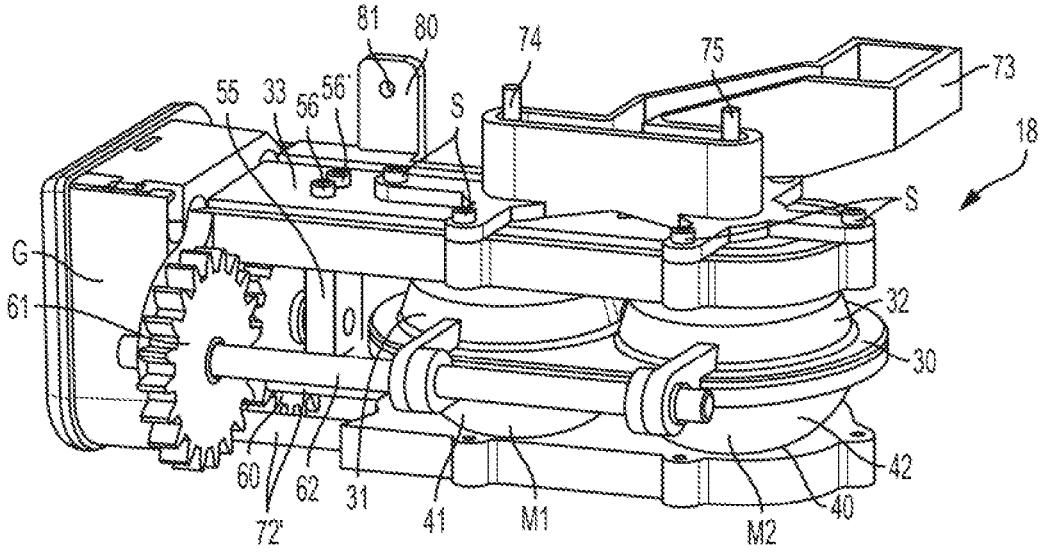
FIG. 2 is a perspective view of the automatic spherical ice maker per se during an ice production mode according to an exemplary embodiment consistent with the present disclosure.
Figure 3:
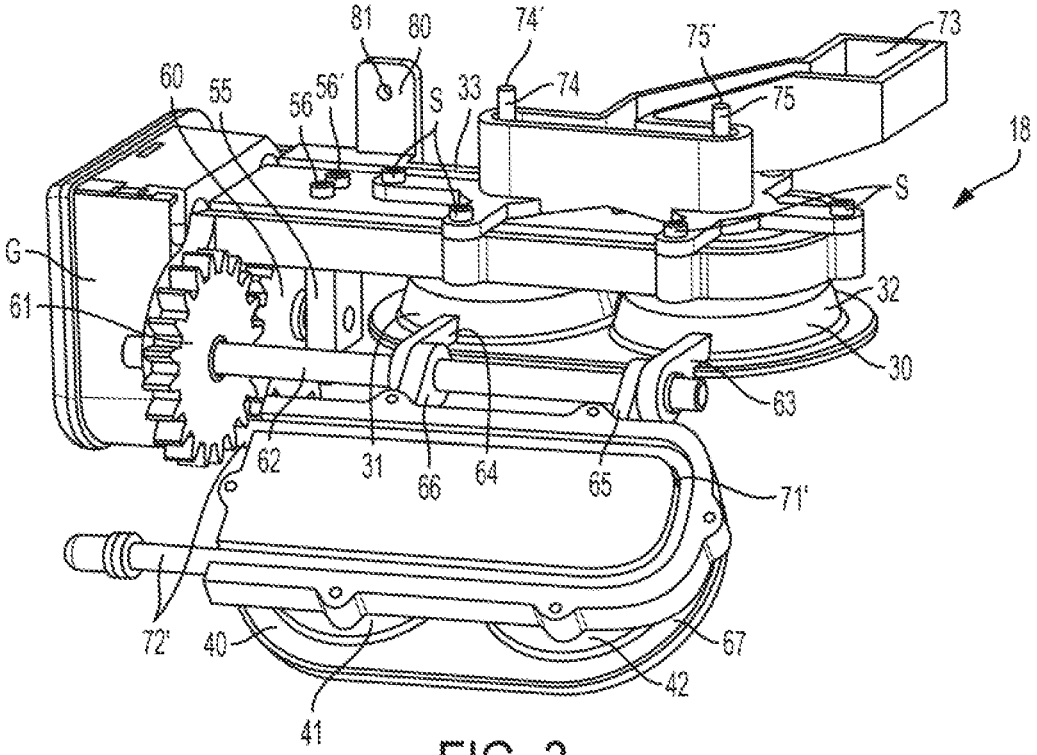
FIG. 3 is a perspective view of the automatic spherical ice maker per se during an ice harvest mode according to an exemplary embodiment consistent with the present disclosure.
Figure 4:
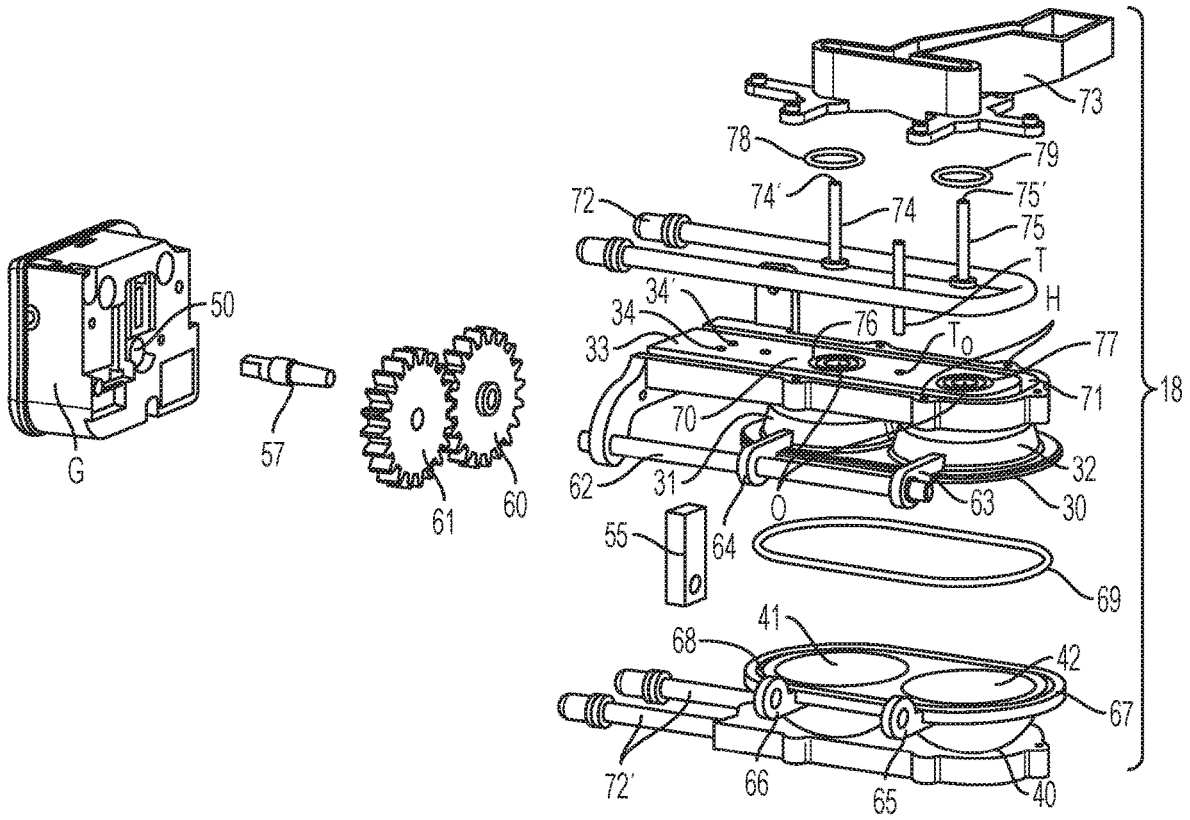
FIG. 4 is an exploded view showing various parts of the automatic spherical ice maker per se according to an exemplary embodiment consistent with the present disclosure.

In particular, the automatic spherical ice maker 18 is configured to make, for example but not limited to, 2.5 inch diameter clear, substantially spherical ice balls that are typically used in bourbon, scotch, whiskey, craft cocktails, soft drinks, and other drinks. As best shown in FIGS. 3 and 4, the automatic spherical ice maker 18 includes an upper stationary ice mold 30 having, for example, two ice cavities 31 and 32 each with a hemispherical shape, and a lower rotatable ice mold 40 having two ice cavities 41 and 42 each with a hemispherical shape and respectively corresponding to the ice cavities 31 and 32 of the upper stationary ice mold 30. Together, as best shown in FIG. 2, the ice cavities 31 and 32 of the upper stationary ice mold 30 and the ice cavities 41 and 42 of the lower rotatable ice mold 40 form two complete spherical molds M1 and M2 which are configured to form two substantially spherical ice balls at a time.

With reference to FIGS. 2-5C, the two ice cavities 31 and 32 of the upper stationary ice mold 30 are mounted on and extend below a mold support plate 33. The mold support plate 33 is mounted to and extends from a gear box G which houses a drive motor 50 (see FIGS. 1, 4, and 5A). The drive motor 50 can be, for example, a DC motor or a stepper motor. A drive shaft support 55 is mounted below the mold support plate 33 by, for example, two screws 56, 56' that pass through holes 34, 34' formed in the support plate 33. The drive shaft support 55 rotatably supports an end of a drive shaft 57 of drive motor 50. A drive gear 60 is fixed using a keyed, splined, tapered, and the like connection to the drive shaft 57 and rotates therewith. The drive gear 60 is configured to mesh with a driven gear 61. The driven gear 61 is fixed using a similar connection as with the drive gear 60 to one end of a driven shaft 62. The driven shaft 62 is rotatably supported at the other end and at the approximate middle portion by driven shaft supports 63 and 64, respectively. The driven shaft support 63 extends from an exterior portion of the ice cavity 32 upper stationary ice mold 30 and the driven shaft support 64 extends from an exterior portion of the ice cavity 31 upper stationary ice mold 30.

The lower rotatable ice mold 40 having two ice cavities 41 and 42 is fixedly mounted to the driven shaft 62 via two spaced-apart extension arms 65 and 66. As shown in FIG. 4, the lower rotatable ice mold 40 has an upper flange portion 67 that surrounds the two ice cavities 41 and 42. The upper flange portion 67 is formed with a groove 68 for receiving a seal member 69 such as, for example, an O-ring seal for providing a seal between the upper stationary ice mold 30 and the lower rotatable ice mold 40 (see FIG. 4) on condition that the lower rotatable ice mold 40 is in a closed position to form the two spherical molds M1 and M2 (see FIGS. 1 and 2).

With reference to FIGS. 4 and 5A-5C, the upper surface 70 of the mold support plate 33 has a generally U-shaped recess or groove 71 for receiving a first heating element 72 which has a complementary U-shape to be fitted in the recess 71. A thermistor T is provided as a separate part and extends down into an opening $T_0$ in the mold support plate 33 and into a location between the molds M1 or M2 to sense the temperature of the molds (see FIGS. 4 and 5A). The thermistor T is connected by wiring (not shown) to the drive motor 50. A shown in FIGS. 4 and 5A to 5C, the mold support plate 33 has a pair of air-vent-filler tubes 74 and 75 disposed in respective openings O formed in the upper surface 70 of the mold support plate 33. Each of the air-vent-filler tubes 74 and 75 has a middle bore 74' and 75', respectively, that serves as a connection between the water fill tubes (not shown) and the two the ice cavities 31 and 32 of the upper stationary ice mold 30. The water fill tubes communicate with a main water inlet tube (not shown) that passes through the inner wall or shell of refrigerator appliance 10. Each of the air-vent-filler tubes 74 and 75 also has, for example, four outer cutouts C formed in a flange portion F that is disposed in a corresponding opening O. The cutouts C serve as vents to allow the air from the spherical molds M1 and M2 to vent air during filling of the closed spherical molds M1 and M2 with water at the beginning of the ice production mode to make room for the water. The air escapes through the four cutouts C surrounding each of the air-vent-filler tubes 74 and 75. Each of the air-vent-filler tubes 74 and 75 can also be wrapped with a heating wire W to keep the air-vent-filler tubes 74 and 75 free of ice. The air-vent-filler tubes 74 and 75 can also transmit heat to the closed spherical molds M1 and M2 so as to influence the freezing of the spherical ice balls.

As shown in FIGS. 2-4, an optional water fill cup 73 may be mounted on the upper surface 70 of the mold support plate 33 by a plurality of fasteners such as, for example, six screws S which are threaded into corresponding holes H formed in the upper surface 70 of the mold support plate 33. When the water fill cup 73 is used, the water fill cup 73 is configured to guide the water received from the main water inlet tube. Moreover, the middle bores 74' and 75' of the tubes 74 and 75, respectively, then serve as the air vent pipes, whereas the cutouts C surrounding each of the air-vent tubes 74 and 75 serve as the water inlets to each of the closed molds M1 and M2. Surrounding the cutouts C and each opening O is a recess or groove 76 and 77 for receiving corresponding O-rings 78 and 79 for sealing the water fill cup 73 to the upper surface 70 of the mold support plate 33. The O-rings 78 and 79 prevent water from being trapped between the upper surface 70 and the water fill cup 73.

As best seen in FIGS. 4 and 5A, the lower rotatable ice mold 40 includes a second heating element 72' that is either disposed in generally U-shaped recess or groove 71' in the lower rotatable ice mold 40 or in direct contact with an exterior thereof. The first heating element 72 of the upper stationary mold 30 and the second heating element 72' of the lower rotatable ice mold 40 thus facilitate release of the two spherical ice balls from the spherical molds M1 and M2 during ice harvest.

As best seen in FIGS. 2 and 3, the automatic spherical ice maker 18 has a tab 80 with a mounting hole 81 for a mounting fastener such as a screw to pass through and fix the automatic spherical ice maker 18 to the wall of the freezer compartment 11 of the refrigerator appliance 10 in the ice compartment region 14. In this way, the automatic spherical ice maker 18 can be fixed in the refrigerator appliance 10 at the time of manufacture, or can be interchanged with and replace an existing, conventional ice cube maker in the refrigerator appliance by the user/consumer later on after purchasing the refrigerator appliance. In the case of interchanging the automatic spherical ice maker 18 for an existing conventional ice cube maker, the automatic spherical ice maker 18 is a direct retrofit for an indirect cooling ice maker that is already in domestic use. In that case, for example, the motor housing and heater of the conventional melt-out ice maker can be used, thereby reducing design complexity to only a few components that are unique to the present automatic spherical ice maker 18.

While the automatic spherical ice maker 18 is shown in FIG. 1 in the upper right hand corner of the freezer compartment 11, there are no limitations regarding the placement of the automatic spherical ice maker 18 with respect to the refrigerator appliance 10. In this regard, FIGS. 6 and 7 illustrate an embodiment where the automatic spherical ice maker 18' is disposed in an ice compartment region 200 located in a fresh food compartment 103, as will be discussed in more detail below.

FIG. 6 illustrates a front perspective view of a French door-bottom mount style refrigerator 100 with the doors open to reveal the ice compartment region 200 including an insulated housing 231 according to an exemplary embodiment consistent with the present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The inner liner side walls of the fresh food compartment 103 include protrusions 109 for supporting shelving (not shown). The right door 105 includes projections 110 for supporting door racks (not shown). Also shown in FIG. 6 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

The ice compartment region 200 is disposed in an upper left hand corner of the fresh food compartment 103. The ice compartment region 200 can be located at other positions within the fresh food compartment 103.

With reference to FIG. 7, the ice compartment region 200 is formed by the U-shaped, insulated housing 231 that cooperates with the inner top wall 103' and the inner back wall 103" of the fresh food compartment 103. As best shown in FIG. 6, the U-shaped, insulated housing 231 is contoured to fit the shape of the inner top wall 103' and an inner back wall 103" of the fresh food compartment 103. The U-shaped, insulated housing 231 includes a U-shaped outer wall 232, a U-shaped insulation (not shown) (formed of, for example, expanded polypropylene (EPP), expanded polystyrene (EPS), vacuum insolated panel (VIP), or polyurethane foam), a U-shaped inner wall 234, a gasket 235 that is disposed between an edge of the U-shaped, insulated housing 231 and the inner top wall 103' and the inner back wall 103" of the fresh food compartment 103, and a housing collar 236 that is disposed on an open front portion of the U-shaped, insulated housing 231, the housing collar 236 having an opening 236' therein for receiving the ice bucket 251. The ice bucket 251 has an insulated front cover C with a finger grip groove (not shown) on the bottom. The ice bucket 251 is shown as a removable ice bucket for storing ice, the removable ice bucket being removably disposed in the ice compartment region 200. The gasket 235 may be an extruded gasket formed from, for example, polyvinyl chloride (PVC) that is rubberized, and that is inserted into a groove that is formed along the edge of the U-shaped, insulated housing 231.

As shown in FIG. 7, the U-shaped, insulated housing 231 also includes locating extensions E (for example, two extensions E) extending from a lower rear portion of the edge, the locating extensions E being configured to fit into a bracket (not shown) positioned in the inner back wall 103" of the fresh food compartment 103. Moreover, the housing collar 236 having the opening 236' therein for receiving the ice bucket 251 further includes a plurality of fastener holes configured to receive fasteners (not shown) for fastening the U-shaped, insulated housing 231 to the inner top wall 103' of the fresh food compartment 103 (see FIG. 6). With such a construction, the U-shaped, insulated housing 231 is slid into position in the upper left hand corner of the fresh food compartment 103 and over the automatic spherical ice maker assembly 18' and then held in place by the locating extensions E at the lower rear portion and the fasteners in the holes.

Since the automatic spherical ice maker 18' is located in the insulated housing 231 in the ice compartment region 200 within the fresh food compartment 103, it is necessary to provide cold air either via a duct (not shown) from the freezer compartment 101 or from a dedicated evaporator (not shown) for the insulated housing 231 or an evaporator cooling tube (not shown) for the automatic spherical ice maker 18'. The evaporator cooling tube may be embedded in or in contact with the upper stationary ice mold 30.

FIG. 8 illustrates one substantially spherical ice ball IB produced by the automatic spherical ice maker according to an exemplary embodiment consistent with the present disclosure and disposed in a drinking glass D. The ice ball IB is also suitable for shorter drinking glasses such as whiskey, scotch, or bourbon type glasses.

When in use, the automatic spherical ice maker 18, 18' according to an exemplary embodiment consistent with the present disclosure produces substantially spherical ice balls IB by filling the spherical cavities of the closed spherical molds M1 and M2 with water through the air-vent-filler tubes 74 and 75 to a predetermined level and then allowing this water to freeze during the ice production mode. The thermal mass of the closed spherical molds M1 and M2 allows sufficient freezing time for the spherical ice to have a clear appearance. When the spherical ice reaches a completely frozen state, the ice harvesting mode begins by activating the first and second heating elements 72 and 72' to slightly melt the ice that is in contact with a surface of each of the closed spherical molds M1 and M2 in order to release the two spherical ice balls IB from the spherical molds M1 and M2. The motor 50 is then activated to rotate the lower rotatable ice mold 40 down away from the upper stationary ice mold 30 to thereby open and release the two spherical ice balls IB from the spherical molds M1 and M2 into the ice storage bucket 21, 251.

An automatic spherical ice maker consistent with the present disclosure provides for the automatic generation of multiple, clear, substantially spherical ice balls at the same time. Moreover, the user/customer has the peace of mind that they always have a supply of ice balls or spheres when desired without having to wait long periods of time or having to manually form the ice balls one-by-one using an ice-ball press or in a manual insulated mold similar to a conventional ice cube tray.

The present invention has substantial opportunity for variation without departing from the spirit or scope of the present invention. For example, the automatic spherical ice maker may be configured to make smaller clear, substantially spherical ice balls, such as but not limited to, 2.0 inch, 1.5 inch, 1.0 inch, etc., diameter ice balls. Also, instead of the sole ice maker or a replacement ice maker, the automatic spherical ice maker could be added as an additional ice maker to the traditional ice maker, especially in high end refrigerator units that are dedicated to use in home bars such as in entertainment rooms and the like. Still further, while FIG. 6 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:

an ice compartment region disposed in at least one of a fresh food compartment or a freezer compartment; and an automatic spherical ice maker disposed in the ice compartment region, the automatic spherical ice maker including an upper stationary ice mold having at least one ice cavity with a hemispherical shape, and a lower rotatable ice mold having at least one ice cavity with a hemispherical shape and corresponding to the at least one ice cavity of the upper stationary ice mold, so that together the at least one ice cavity of the upper stationary ice mold and the at least one ice cavity of the lower rotatable ice mold form at least one spherical mold which is configured to produce at least one substantially spherical ice ball at a time, wherein the upper stationary ice mold has a first heating element and the lower rotatable ice mold has a second heating element, thereby to facilitate release of the at least one substantially spherical ice ball from the at least one spherical mold, wherein the at least one ice cavity of the u per stationary ice mold is mounted on and extends below a mold support plate, wherein an upper surface of the mold support plate has a U-shaped recess or groove, when viewed from the top of the automatic spherical ice maker, for receiving the first heating element, and wherein a lower surface of the lower rotatable ice mold has a U-shaped recess or groove, when viewed from the bottom of the automatic spherical ice maker, for receiving the second heating element.

2. The refrigerator of claim 1, wherein the upper stationary ice mold has two ice cavities each with a hemispherical shape, and the lower rotatable ice mold has two ice cavities each with a hemispherical shape and respectively corresponding to the two ice cavities of the upper stationary mold, so that together the two ice cavities of the upper stationary ice mold and the two ice cavities of the lower rotatable ice mold form two spherical molds which are configured to produce two substantially spherical ice balls at a time.

3. The refrigerator of claim 1, wherein the at least one substantially spherical ice ball has a diameter of approximately 2.5 inches.

4. The refrigerator of claim 1, wherein the lower rotatable ice mold is fixedly mounted to a driven shaft via two spaced-apart extension arms.

5. The refrigerator of claim 4, wherein the driven shaft includes a driven gear which is coupled to a drive shaft via a drive gear, and the drive shaft is coupled to a drive motor.

6. The refrigerator of claim 5, wherein the drive motor comprises one of a DC motor or a stepper motor.

7. The refrigerator of claim 2, wherein the lower rotatable ice mold has an upper flange portion that surrounds the two ice cavities, and wherein the upper flange portion is formed with a groove for receiving a seal member for providing a seal between the upper stationary ice mold and the lower rotatable ice mold on condition that the lower rotatable ice mold is in a closed position to form the two spherical molds.

8. The refrigerator of claim 2, wherein the two ice cavities of the upper stationary ice mold are mounted on and extend below the mold support plate.

9. The refrigerator of claim 1, wherein the mold support plate has an air-vent-filler tube disposed in an opening formed in the upper surface of the mold support plate, the air-vent-filler tube including a plurality of outer cutouts formed in a flange portion that is disposed in the opening formed in the upper surface of the mold support plate.

10. The refrigerator of claim 9, wherein the air-vent-filler tube includes a middle bore that serves as an air vent pipe, and wherein the plurality of outer cutouts serve as water inlets to the at least one spherical mold.

11. The refrigerator of claim 1, wherein the automatic spherical ice maker is configured to be either fixed in the ice compartment region of the refrigerator or interchanged with and replace an existing ice cube maker in the ice compartment region of the refrigerator.

12. An automatic spherical ice maker for a refrigerator appliance, comprising:

an upper stationary ice mold having at least one ice cavity with a hemispherical shape, and a lower rotatable ice mold having at least one ice cavity with a hemispherical shape and corresponding to the at least one ice cavity of the upper stationary ice mold, so that together the at least one ice cavity of the upper stationary ice mold and the at least one ice cavity of the lower rotatable ice mold form at least one spherical mold which is configured to produce at least one substantially spherical ice ball at a time, wherein the upper stationary ice mold has a first heating element and the lower rotatable ice mold has a second heating element, thereby to facilitate release of the at least one substantially spherical ice ball from the at least one spherical mold, wherein the at least one ice cavity of the upper stationary ice mold is mounted on and extends below a mold support plate, wherein an upper surface of the mold support plate has a U-shaped recess or groove, when viewed from the top of the automatic spherical ice maker, for receiving the first heating element, and wherein a lower surface of the lower rotatable ice mold has a U-shaped recess or groove, when viewed from the bottom of the automatic spherical ice maker, for receiving the second heating element.

13. The automatic spherical ice maker of claim 12, wherein the upper stationary ice mold has two ice cavities each with a hemispherical shape, and the lower rotatable ice mold has two ice cavities each with a hemispherical shape and respectively corresponding to the two ice cavities of the upper stationary mold, so that together the two ice cavities of the upper stationary ice mold and the two ice cavities of the lower rotatable ice mold form two spherical molds which are configured to produce two substantially spherical ice balls at a time.

14. The automatic spherical ice maker of claim 12, wherein the at least one substantially spherical ice ball has a diameter of approximately 2.5 inches.

15. The automatic spherical ice maker of claim 12, wherein the lower rotatable ice mold is fixedly mounted to a driven shaft via two spaced-apart extension arms.

16. The automatic spherical ice maker of claim 15, wherein the driven shaft includes a driven gear which is coupled to a drive shaft via a drive gear, and the drive shaft is coupled to a drive motor.

17. The automatic spherical ice maker of claim 16, wherein the drive motor comprises one of a DC motor or a stepper motor.

18. The automatic spherical ice maker of claim 13, wherein the lower rotatable ice mold has an upper flange portion that surrounds the two ice cavities, and wherein the upper flange portion is formed with a groove for receiving a seal member for providing a seal between the upper stationary ice mold and the lower rotatable ice mold on condition that the lower rotatable ice mold is in a closed position to form the two spherical molds.

19. The automatic spherical ice maker of claim 13, wherein the two ice cavities of the upper stationary ice mold are mounted on and extend below the mold support plate.

20. The automatic spherical ice maker of claim 12, wherein the mold support plate has an air-vent-filler tube disposed in an opening formed in the upper surface of the mold support plate, the air-vent-filler tube including a plurality of outer cutouts formed in a flange portion that is disposed in the opening formed in the upper surface of the mold support plate.

21. The automatic spherical ice maker of claim 20, wherein the air-vent-filler tube includes a middle bore that serves as an air vent pipe, and wherein the plurality of outer cutouts serve as water inlets to the at least one spherical mold.

22. An automatic spherical ice maker for a refrigerator appliance, comprising:

an upper stationary ice mold having at least one ice cavity with a hemispherical shape, and a lower rotatable ice mold having at least one ice cavity with a hemispherical shape and corresponding to the at least one ice cavity of the upper stationary ice mold, so that together the at least one ice cavity of the upper stationary ice mold and the at least one ice cavity of the lower rotatable ice mold form at least one spherical mold which is configured to produce at least one substantially spherical ice ball at a time, wherein the automatic spherical ice maker is configured to be interchanged with and replace an existing ice cube maker in the refrigerator appliance.

23. A refrigerator comprising:

an ice compartment region disposed in at least one of a fresh food compartment or a freezer compartment; and an automatic spherical ice maker disposed in the ice compartment region, the automatic spherical ice maker including an upper stationary ice mold having two ice cavities each with a hemispherical shape, and a lower rotatable ice mold having two ice cavities each with a hemispherical shape and respectively corresponding to the two ice cavities of the upper stationary mold, so that together the two ice cavities of the upper stationary ice mold and the two ice cavities of the lower rotatable ice mold form two spherical molds which are configured to produce two substantially spherical ice balls at a time, wherein the upper stationary ice mold has a first heating element and the lower rotatable ice mold has a second heating element, thereby to facilitate release of the two substantially spherical ice balls from the two spherical molds, wherein the two ice cavities of the upper stationary ice mold are mounted on and extend below a mold support plate, wherein the mold support plate has a pair of air-vent-filler tubes disposed in respective openings formed in an upper surface of the mold support plate, and wherein each one of the pair of air-vent-filler tubes includes a plurality of outer cutouts formed in a flange portion that is disposed in a corresponding one of the openings formed in the upper surface of the mold support plate.

* * * * *